US011517961B2

(12) United States Patent
Collura et al.

(10) Patent No.: US 11,517,961 B2
(45) Date of Patent: Dec. 6, 2022

(54) SLIDE CLOSURE FOR VESSEL CONTAINING MOLTEN METAL

(71) Applicant: VESUVIUS GROUP, S.A., Ghlin (BE)

(72) Inventors: Mariano Collura, Strepy-Bracquegnies (BE); Fabrice Sibiet, Colleret (FR); Jason Quinn, Mahomet, IL (US); Jeffrey Butts, Veedersburg, IN (US); Stephen J Adams, Monticello, IL (US)

(73) Assignee: VESUVIUS GROUP, S.A., Ghlin (BE)

( * ) Notice: Subject to any disclaimer, the term of this patent is extended or adjusted under 35 U.S.C. 154(b) by 0 days.

(21) Appl. No.: 17/619,372

(22) PCT Filed: Jun. 16, 2020

(86) PCT No.: PCT/EP2020/066653
§ 371 (c)(1),
(2) Date: Dec. 15, 2021

(87) PCT Pub. No.: WO2020/254338
PCT Pub. Date: Dec. 24, 2020

(65) Prior Publication Data

US 2022/0226890 A1 Jul. 21, 2022

(30) Foreign Application Priority Data

Jun. 21, 2019 (EP) ..... 19181862

(51) Int. Cl.
*B22D 41/28* (2006.01)

(52) U.S. Cl.
CPC ..... *B22D 41/28* (2013.01)

(58) Field of Classification Search
CPC ..... B22D 41/20; B22D 41/28; B22D 41/30; B22D 41/38; B22D 41/40
See application file for complete search history.

(56) References Cited

U.S. PATENT DOCUMENTS

| | | | | |
|---|---|---|---|---|
| 4,717,128 | A | 1/1988 | Bruckner | |
| 2015/0246392 | A1 | 9/2015 | Gisler | |
| 2017/0259332 | A1* | 9/2017 | Zingre | B22D 41/40 |
| 2018/0009028 | A1 | 1/2018 | Cousin | |
| 2018/0333773 | A1 | 11/2018 | Imahase | |

FOREIGN PATENT DOCUMENTS

| | | | |
|---|---|---|---|
| DE | 19615696 | C2 | 1/1999 |
| EP | 0587485 | A1 | 3/1994 |
| EP | 2906376 | B1 | 4/2019 |

* cited by examiner

*Primary Examiner* — Kevin P Kerns
*Assistant Examiner* — Steven S Ha
(74) *Attorney, Agent, or Firm* — Blue Filament Law PLLC

(57) ABSTRACT

Slide closure for a vessel that operatively contains molten metal, comprising: a slide housing including a recess receiving a first refractory closure plate; a slide unit including an opening receiving a second refractory closure plate; wherein at least one clamping mechanism is arranged to start the clamping of the corresponding refractory closure plate via an actuation of the at least one clamping mechanism when the slide unit is displaced relative to the slide housing and the first and the second refractory closure plates are distant apart from each other, essentially before the first and the second faces of the respective first and the second refractory closure plates are in contact under pressure.

15 Claims, 6 Drawing Sheets

SLIDE CLOSURE FOR VESSEL CONTAINING MOLTEN METAL

CROSS-REFERENCE TO RELATED APPLICATIONS

This application is the National Stage application of International Application No. PCT/EP2020/066653, filed Jun. 16, 2020, which claims the benefit of European Provisional Patent Application No. EP 19181862.4, filed Jun. 19, 2019, the contents of each of which are incorporated by reference into this specification.

FIELD OF THE INVENTION

The invention relates to a slide closure for a vessel operatively containing molten metal, as well as to a method for operating said slide closure.

BACKGROUND AND PRIOR ART

Sliding clamping devices are frequently installed on slide closures for vessel containing molten metal. The purpose of the clamping devices is to keep opposed refractory closure plates inserted into a given slide housing in a pre-constrained state so that possible cracks formed in the respective refractory closure plates due to extreme operating conditions do not widen any further.

Examples of sliding clamping devices are known from documents U.S. Pat. No. 4,717,128; EP 587 485; DE 196 15 696 C2. The use of pre-constrained refractory closure plates prevents that molten metal seep through possible cracks ensuring a proper sealing of the slide closure. Generally, the pre-constrained state of each refractory closure plate is obtained by a spring element that is pre-constrained. The drawback of this known solution to prevent cracks is that the spring element can only be adjusted during a maintenance operation. However, the elements of the slide closure are still very hot during the maintenance rendering the pre-setting of the spring element particularly cumbersome. To overcome this prejudice, patent EP2906376B1 proposes an automatic clamping of the refractory closure plates upon the bracing of the slide unit against the slide housing, wherein the clamping mechanism is actuated by the cooperation between the slide unit and the slide housing. The shortcoming of this solution is that the clamping takes place when the refractory closure plates are pressed against each other. The shear forces resulting from the relative displacement between the refractory closure plates disturb the concomitant automatic pre-tensioning of the refractory closure plates.

AIMS OF THE INVENTION

The invention aims to provide a solution to at least one drawback of the teaching provided by the prior art.

More specifically, the invention aims to provide a solution to improve the clamping process of the refractory closure plates.

SUMMARY OF THE INVENTION

For the above purpose, the invention is directed to a slide closure for a vessel that operatively contains molten metal, comprising: a slide housing including a recess receiving a first refractory closure plate presenting a first face with a first flow-through opening; a slide unit including an opening receiving a second refractory closure plate presenting a second face with a second flow-through opening; wherein said slide closure is arranged such that the slide unit is displaced relative to the slide housing in a longitudinal direction; wherein said slide closure is further arranged such that a gap or the pressure between opposing first and second faces of the first and second refractory closure plate can be adjusted by parallel displacement in an axial direction; wherein at least one clamping mechanism is arranged in the slide housing and/or the slide unit, the at least one clamping mechanism is adapted to clamp the corresponding refractory closure plate; wherein the at least one clamping mechanism is arranged to start the clamping of the corresponding refractory closure plate via an actuation of the at least one clamping mechanism when the slide unit is displaced relative to the slide housing and the first and the second refractory closure plates are distant apart from each other, essentially before the first and the second faces of the respective first and the second refractory closure plates are in contact under pressure.

According to specific embodiments of the invention, the device comprises one of more the following technical features, taken in isolation or any combination thereof:

- the at least one clamping mechanism is arranged to end the actuation of the at least one clamping mechanism of the corresponding refractory closure plate before the first and the second faces of the respective first and the second refractory closure plates are in contact under pressure;
- said slide closure comprises at least one ramp engaging with at least one corresponding guiding element arranged on the slide unit, wherein said ramp and said guiding element are arranged to move apart the slide unit from the slide housing when the slide unit reaches a specific portion of a stroke of the slide unit, particularly an end stroke;
- the at least one clamping mechanism comprises a first and a second clamping mechanisms, wherein the first clamping mechanism is arranged on the slide housing and is actuated by a first cooperating element arranged on the slide unit, wherein the second clamping mechanism arranged on the slide unit is actuated by a second cooperating element arranged on the slide housing;
- the at least one clamping mechanism comprises at least one spring element;
- the at least one spring element is shaped as a U spring clip, two ends of said spring element corresponding to the two branches of the U.
- the at least one spring element of the slide housing or unit comprises a spring element having one end of the opposing ends abutting against a portion of a sidewall of the corresponding first or second refractory closure plate and the other end of the opposing ends abutting against a pre-tensioning element arranged on the corresponding slide housing or unit;
- the at least one spring element of the slide housing or unit comprises a further spring element having one end of the opposing ends abutting against another portion of the sidewall of the corresponding first or second refractory closure plate and the other end of the opposing ends abutting against an abutment element mounted on the corresponding slide housing or unit, or another portion of the sidewall of the corresponding first or second refractory closure plate abuts directly against an abutment element mounted on the corresponding slide housing or unit;

each pre-tensioning element is a sliding element comprising a sidewall in sliding contact with the other end of the corresponding at least one spring element of the slide housing or unit, said sidewall and a shape of said spring element being both arranged such that a longitudinal displacement of said sliding element squeezes said plate within its recess;

the first or the second cooperating elements each comprise a catch profile element;

each catch profile element presents a ramp adjacent to at least one claw, preferably two claws;

each catch profile element is resiliently connected to the corresponding slide housing or unit so that said catch profile element can be biased in an axial direction;

the sliding element of the slide housing or unit comprises a protrusion adapted to cooperate with the catch profile element arranged on the corresponding opposing slide unit or housing, wherein each catch profile element can push the corresponding sliding element via said protrusion in the longitudinal direction while the slide unit is displaced relative to the slide housing.

The invention also relates to a method for the placement of refractory closure plates in a slide closure comprising the following steps:

providing respectively a first and second clamping mechanisms to a slide housing and a slide unit; inserting respectively a first refractory closure plate and a second refractory closure plate within recesses of the slide housing and the slide unit when the slide closure is in an accessible position;

closing the slide closure so that the slide unit is facing the slide housing;

starting the clamping of the first and/or the second refractory closure plates when the slide unit is displaced relative to the slide housing and a first and second surfaces of the respective first and second refractory closure plates are distant apart from each other, before the first and second surfaces of the respective first and second refractory closure plates are under working pressure.

The present invention is also advantageous since it reduces the time to exchange the refractory closure plates because the manual tightening of the refractory closure plates is not necessary. Furthermore, the use of the refractory closure plates can be prolonged thanks to a better tightening of the refractory closure plate within the respective recesses. Moreover, the automatic clamping design allows a more systematic clamping, wherein the tension can be accurately adjusted in a repeatable manner. The device according to the invention can finally be adapted to different sizes of slide closure and/vessel.

In general, the preferred embodiments of each subject-matter of the invention are also applicable to the other subject-matters of the invention. As far as possible, each subject-matter of the invention is combinable with other subject-matter. The features of the invention are also combinable with the embodiments of the description, which in addition are combinable with each other.

BRIEF DESCRIPTION OF THE FIGURES

Preferred aspects of the invention will now be described in more detail with reference to the appended drawings, wherein same reference numerals illustrate same features and wherein.

LIST OF REFERENCE SYMBOLS

2 slide closure
6A slide housing
6B slide unit
6C guiding frame
8A, 8B Refractory closure plate
22A, 22B (first) spring element
24A, 24B (second) spring element
26A, 26B pre-tensioning element, sliding element
28A, 28B abutment element, abutment insert
30 Ramp
32 guiding element
40A, 40B cooperating element, catch profile element
42A, 42B Protrusion
50 Rollers

DESCRIPTION OF PREFERRED EMBODIMENTS OF THE INVENTION

Figure 1:
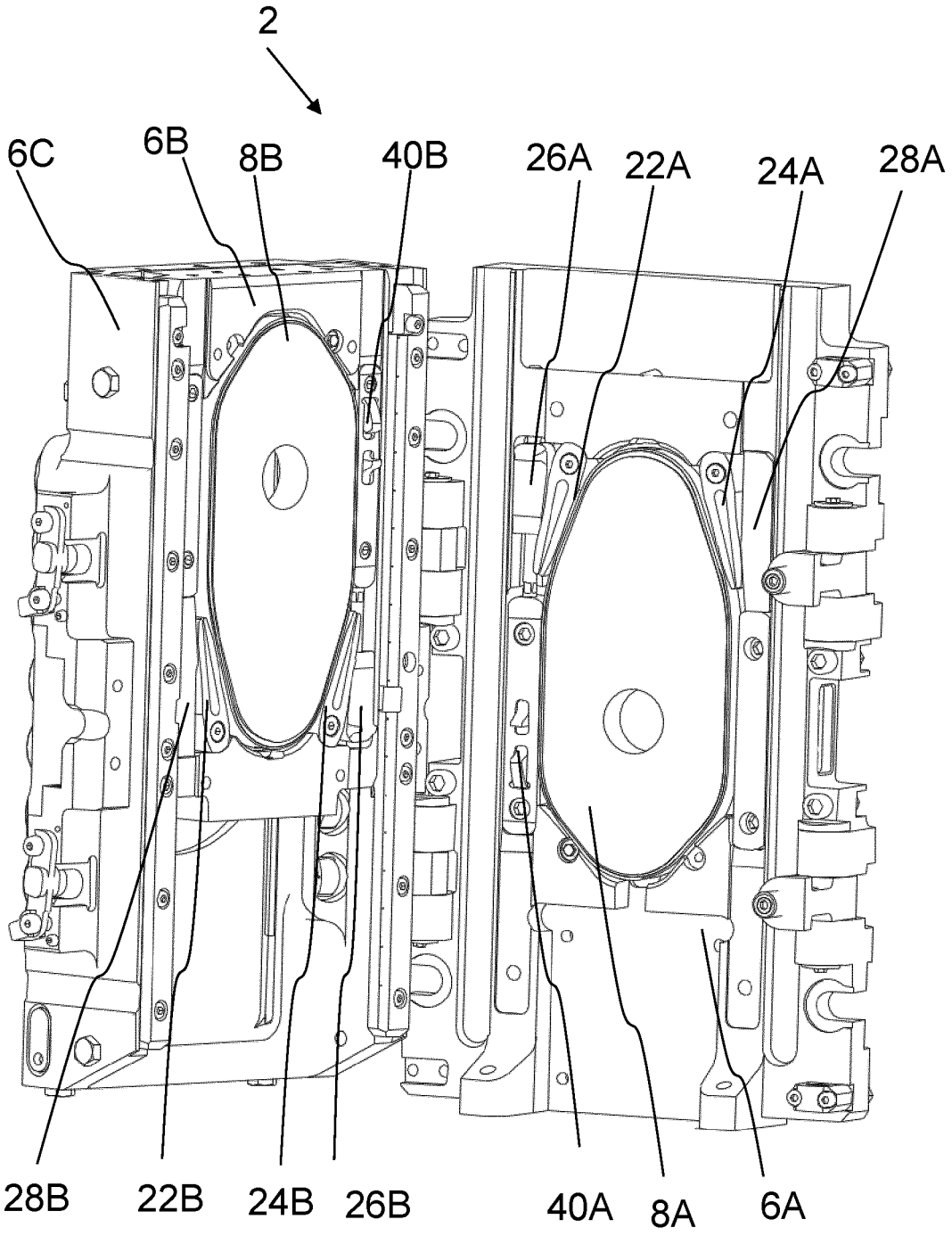
FIG. 1 represents a perspective schematic view of a slide closure.

FIG. 1 is a perspective view of a slide closure 2 for a vessel for containing molten metal (not shown). The slide closure 2 comprises a slide housing 6A attached to the vessel and a slide unit 6B that is displaceable relative to the slide housing 6A in operation. The relative displacement between the slide unit 6B and the slide housing 6A allows the flow control of the molten metal.

In FIG. 1, the slide closure 2 is in an open unfolded (accessible) position for its maintenance and extends in a vertical direction. To facilitate the maintenance, the vessel can be rotated by 90° so that the sliding closure 2, which is normally in use arranged horizontally at the bottom of the vessel is positioned vertically. The slide unit 6A can slide within a guiding frame 6C that can be connected to the slide housing 6A via a hinge, as shown in FIG. 1. The slide housing 6A and the slide unit 6B comprise recesses for receiving a first refractory closure plate 8A and a second refractory closure plate 8B. The first refractory closure plate 8A and the second refractory closure plate 8B respectively have a first face with a first flow-through opening and a second face with a second flow-through opening. In use, the relative positioning of the first flow-through opening to the second flow-through opening allows controlling the flow of molten metal to be discharged. The control can be performed gradually between a fully open position, in which the two openings coincide each other and a fully closed position, in which the two openings are completely offset from each other.

Figure 2:
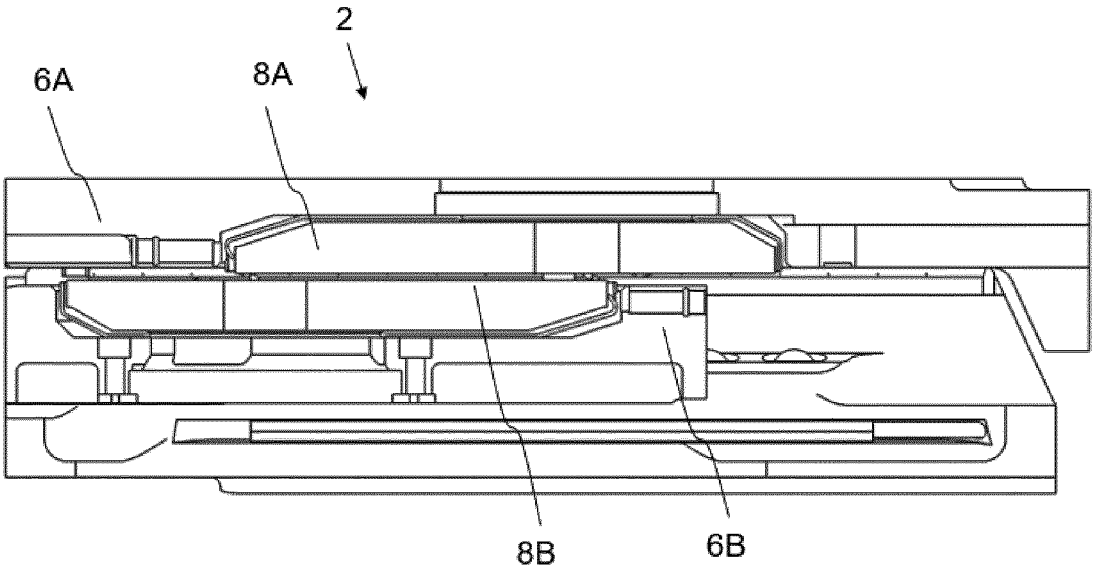
FIG. 2 shows a schematic sectional view of the slide closure.

FIG. 2 shows the slide closure 2 in closed position, after pivoting of the guiding frame 6C form its open position for maintenance as shown in FIG. 1. In the closed position, the slide unit 6B is facing the slide housing 6A. Here, a gap is present between said first and second refractory closure plates 8A, 8B. This gap extending in an axial direction can be adjusted by parallel displacement of the slide unit 6B.

The choice of a connection of the guiding frame 6C to the slide housing 6A is not limited to a hinged arrangement, any other suitable arrangement can be envisaged. For instance, the guiding frame 6C is not necessary for some applications where the sliding unit 6B is directly braced upon the sliding housing 6A.

Figure 3:
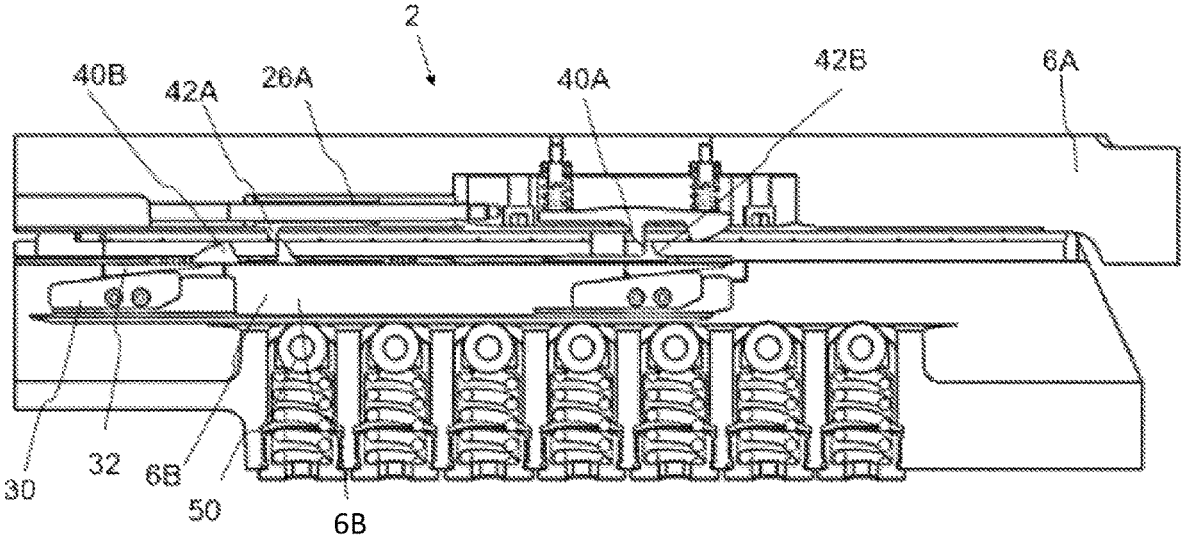
FIG. 3 represents a schematic lateral view of the slide closure

The slide unit 6B is configured to move, additionally to the axial direction, in a longitudinal direction. The displacement along the longitudinal direction is not only used to control the flow of molten metal to be discharged when the vessel is in use but also to adjust the gap or the pressure between first and second refractory closure plate 8A, 8B. Indeed, FIG. 3 shows that the parallel displacement of the slide unit 6B can be ensured by at least one ramp 30 arranged for instance on the guiding frame 6C engaging with the corresponding guiding elements 32 arranged on the slide unit 6B. The longitudinal displacement of the slide unit 6B relative to the slide housing is ensured by a driving element (not shown) such as a hydraulic actuator or the like. The driving element can be arranged on the guiding frame. A moving end of the driving element can be attached to slide unit 6B in a form-fitting manner (not shown). The ramps 30 and the guiding elements 32 can be configured to increase the gap between the slide unit 6B and the slide housing 6A when the slide unit 6B reaches a specific portion of a stroke of the slide unit 6B. The specific portion is an end stroke (over stroke) of the slide unit 6B as shown in FIG. 3.

FIG. 4A-E show a schematic representation of different stages in the displacement of the slide unit 6B relative to the slide housing 6A attached to the vessel (not shown).

Figure 4A:
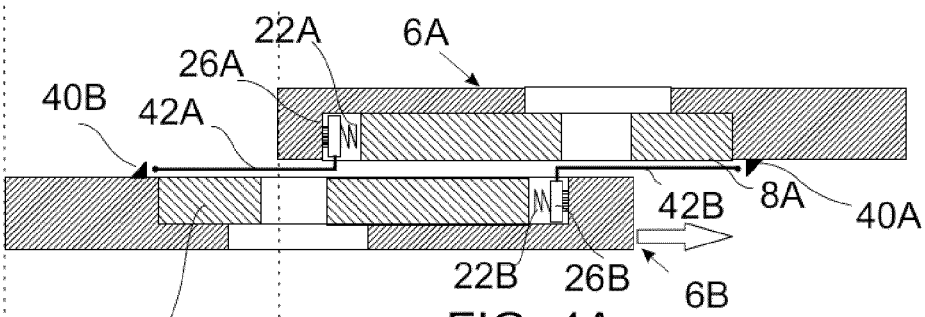
FIG. 4A-E show a simplified representation of different stages in the displacement of a slide unit relative to a slide housing.

FIG. 4A represents the slide unit 6B and the slide housing 6A distant apart from each other with the slide housing 6A in an end stroke position. In this position, the first and second refractory plates are loose to the extent that the spring elements 22A, 22B are not yet put under tension by their respective pre-tensioning element 26A, 26B that do not yet cooperate with the respective catch profile element 40A, 40B. The respective clamping mechanisms on each part comprise at least one spring element 22A, 22B and the corresponding pre-tensioning element 26A, 26B.

Once the first and second refractory plates 8A, 8B are inserted in their respective recesses, the clamping process starts by moving the slide housing 6B to the right as indicated by the arrow in FIG. 4A.

Figure 4B:
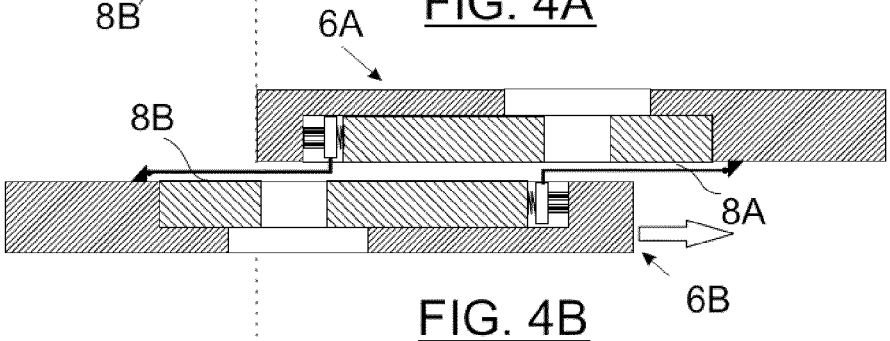

FIG. 4B represents the moment just before the clamping process ends. The spring elements 22A, 22B are symbolically presented as being compressed indicating that the first and second refractory plates 8A, 8B are clamped in their respective recesses. The clamping process preferably ends when the slide unit 6B and the slide housing 6A are still distant apart from each other which allows a proper positioning of each refractory plate 8A, 8B without the necessity to overcome the shear forces between both refractory plates 8A, 8B. Between the stages illustrated in FIG. 4A and FIG. 4B, the slide unit 6B moves relative to the slide housing 6A in a longitudinal direction (indicated by an arrow), and optionally in an axial direction. The skilled person knows how to adapt the longitudinal direction and/or axial direction by adjusting for instance the slope of the ramps 30 and the guiding element 32.

Once the actuation of the clamping of the first and second refractory plates 8A, 8B is achieved, the catch profile elements 40A and 40B are disengaged form the pre-tensioning element 26A, 26B so that no further pressure is exerted (not illustrated). The pre-tensioning element 26A, 26B are configured so that they are locked in place once the cooperation with the respective catch profile elements 40A, 40B ends. To achieve this, the pre-tensioning element 26A, 26B can be tightened in friction or by a one-way clutch system.

Figure 4C:
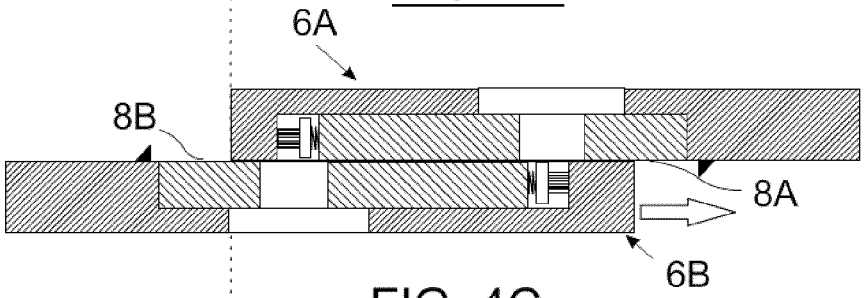

FIG. 4C shows the moment when first and second refractory plates 8A, 8B, despite being in direct contact with each other, are still not under working pressure. Between the stages shown in FIG. 4B and FIG. 4C, the slide unit 6A moves relative to the slide housing 6B in a longitudinal direction (indicated by an arrow) and an axial direction to close the gap between the two refractory closure plates 8A, 8B.

Figure 4D:
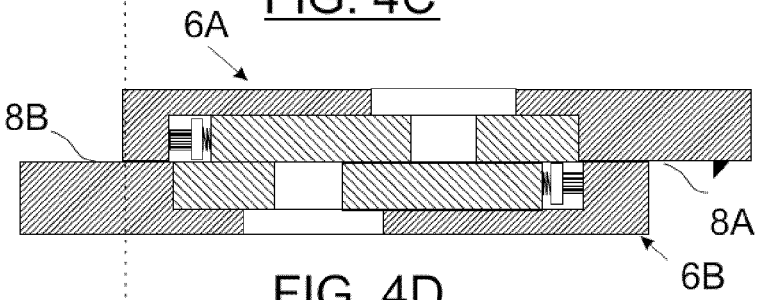

FIG. 4D illustrates the moment when the pressure between the first and second refractory plates reach an operational level (working pressure) sufficient to allow a proper sealing of the slide closure 2. Between the stages illustrated in FIG. 4C and FIG. 4D, the slide unit 6B moves relative to the slide housing 6A in a longitudinal direction. During this transition, the pressure between first and second refractory plates 8A, 8B is increased by a dedicated mechanism, which preferably comprises a plurality of rollers 50 biased against the slide unit 6B as shown in FIG. 3. The rollers 50 are preferably in direct contact with the opposed face of the slide unit 6B. The profile of the opposed face of the slide unit 6B is configured such that the working pressure remains a in pre-determined range of pressures. During this transition, the shear forces between the two refractory closure plates 8A, 8B also increase. Since the start of clamping of the refractory closure plates 8A, 8B takes place as they are distant apart from each other, the positioning and tightening of each refractory closure plate remain stable even under the shear forces. It should be noted, that the positioning of the refractory closure plates 8A, 8B is facilitated when the clamping process ends before both two plates 8A, 8B touch each other.

Figure 4E:
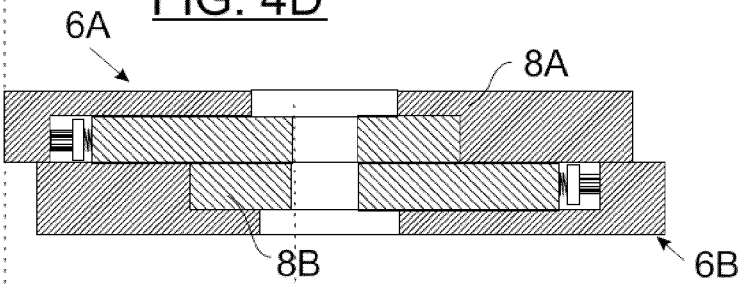

FIG. 4E illustrates the moment when the openings of the first and second refractory closure plates 8A, 8B coincide allowing a maximal discharge flow of the molten metal.

Figure 5A:
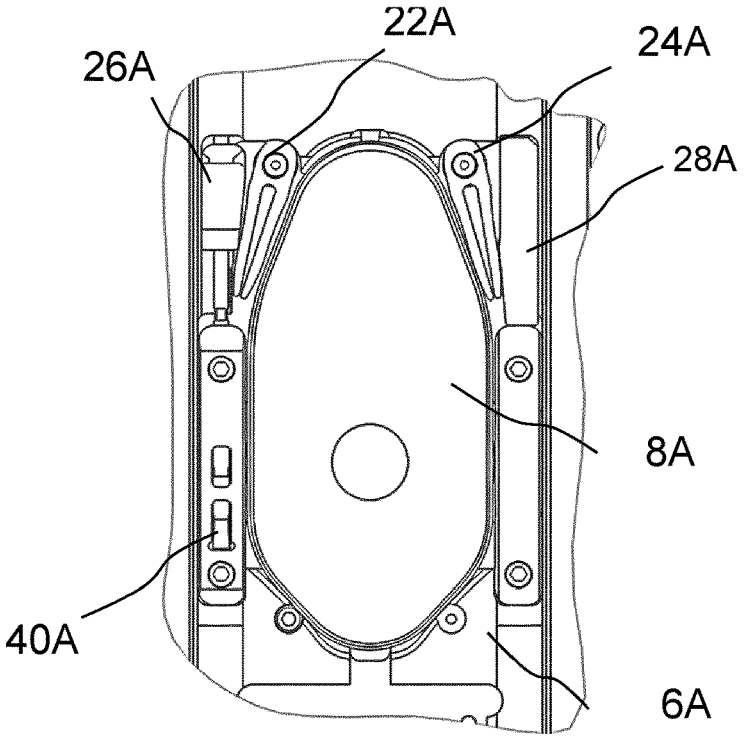
FIG. 5A illustrates a schematic front view of a first embodiment of the slide housing receiving a first refractory closure plate with two spring elements.

FIG. 5A discloses an arrangement including a (first) refractory closure plate 8A, a clamping mechanism 22A, 24A, 26A, 28A as well as a catch element 40A arranged on the contact face of the slide housing 6A. The clamping mechanism 22A, 24A, 26A, 28A preferably comprises a pre-tensioning element 26A, a first spring element 22A, a second spring element 24A and an abutment element 28A. The same arrangement is present on the opposing contact face on the slide unit 6B (not represented). The slide unit 6B and the slide housing 6A cooperate and are aimed to be pressed against each other. For instance, the catch profile element 40B of the slide unit 6B (not illustrated) can actuate the pre-tensioning element 26A of the slide housing 6A and vice versa.

Furthermore, the slide housing in FIG. 5A comprises a first and second spring elements 22A, 24A arranged on both side of the refractory closure plate 8A. Each spring element 22A, 22B is preferably shaped as a U spring clip. Each spring element 22A, 24A can be equivalently described as being shaped as a crabs claw. Each spring element 22A, 24A is pivotally arranged on a shaft on the corresponding slide housing 6A. The pivot is preferably located in a median position of the corresponding spring element 22A, 24A at a median position (apex) of the U (crabs claw). The first spring element 22A has one end (one branch of the U) resting against a portion of a sidewall of the corresponding first closure plate 8A, and the other end (other branch of the U)

resting against the pre-tensioning element 26A (e.g. sliding element 26A), being slidably attached to slide housing unit 6A. When slide unit 6B is displaced relative to the slide housing 6A, the catch element 40B (not shown) of the slide unit (not shown) engages with a protrusion 42A, 42B formed on the slide element 26A. The slide element 26A is preferably at least guided by a rod extending between two abutting ends. The rod can extend through an opening formed in the sliding element 26A. The sliding element 26A preferably has one side aimed at being in sliding contact with the corresponding branch of the spring element 22A.

During the clamping process, the sliding element 26A moves from one abutting end towards the other. Once the sliding element 26A touches the adjacent branch of the first spring element 22A, the first spring element 22A preferably starts to rotate and, the translation motion of the sliding element 26A is transformed into a slight rotation of the first spring element 22A.

Once the other branch of the first spring element 22A abuts against the refractory closure plate 8A, the refractory plate 8A is pushed by the other branch of the spring element 22A. When the sliding element 26A is moved further, the refractory closure plate is pressed against the second spring element 24A. The second spring element 24A can also be pivotally arranged on the slide housing 6A. The amplitude of the rotation of the second spring element can be limited by the abutment element 28A (e.g. an insert as shown in FIG. 5A or integrally formed in the slide housing 6A, not shown). The effective clamping of the refractory plate 8A starts when all the gaps between the elements of the clamping mechanism disappear. The longitudinal displacement of the sliding element 26A aims at squeezing the refractory closure plate within its recess. After this stage, any additional stroke of the sliding element 26A is transformed into a pre-stress of the refractory closure plate 8A. The actuation of the clamping process is achieved when the catch profile element 40B (not shown) is disengaged from the protrusion 42A, 42B formed on the sliding element 26A. After the disengagement, the sliding element 26A is preferably hold in place by the friction between the sliding element 26A and the spring element 22A.

The arrangement of the slide housing 6A described above applies to the slide unit 6B.

Figure 5B:
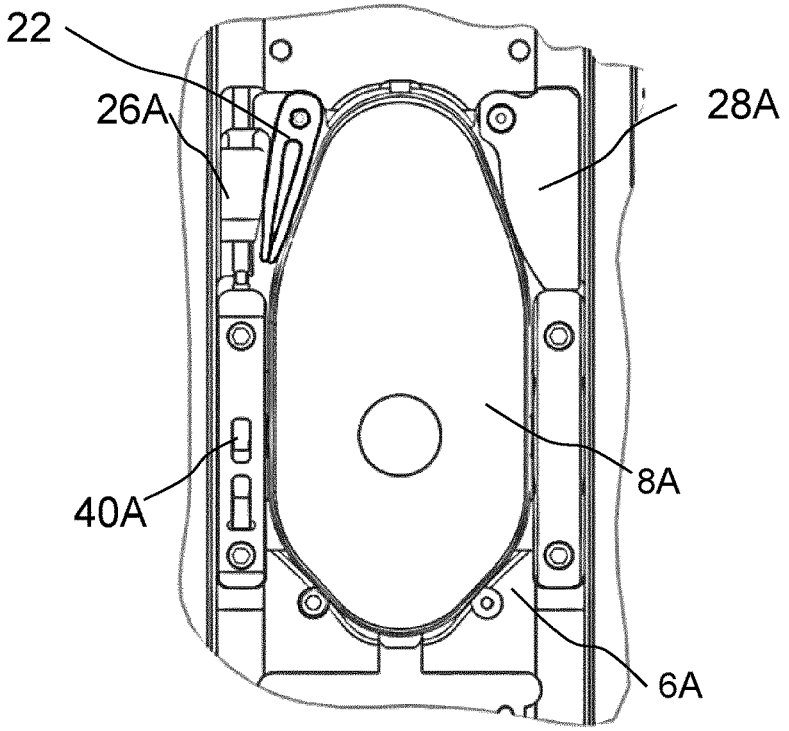
FIG. 5B represents a schematic front view of a second embodiment of the slide housing receiving a first refractory closure plate with one single spring element.

Alternatively to the clamping mechanism in FIG. 5A, the slide housing 6A in FIG. 5B comprises only one spring element 22A arranged only on one side of the refractory closure plate 8A. The only differences between this alternative and the previous embodiment reside in the fact that only one spring element 22A, 22B is used and the refractory closure plate 8A directly abuts against an abutment element 28A (e.g. an insert as shown in FIG. 5B or integrally formed in the slide housing 6A, not shown) arranged on a side of the slide housing 6A opposed to the sliding element 26A. During the clamping process of this alternative, it should be noted that once the other branch of the spring element 26A abuts against the refractory closure plate 8A, the refractory closure plate 8A is pushed by the other branch of the spring element 22A until the refractory closure plate 8A directly rests against an abutment element 28A. The arrangement of the slide housing 6A described above applies to the slide unit 6B.

Figure 6:
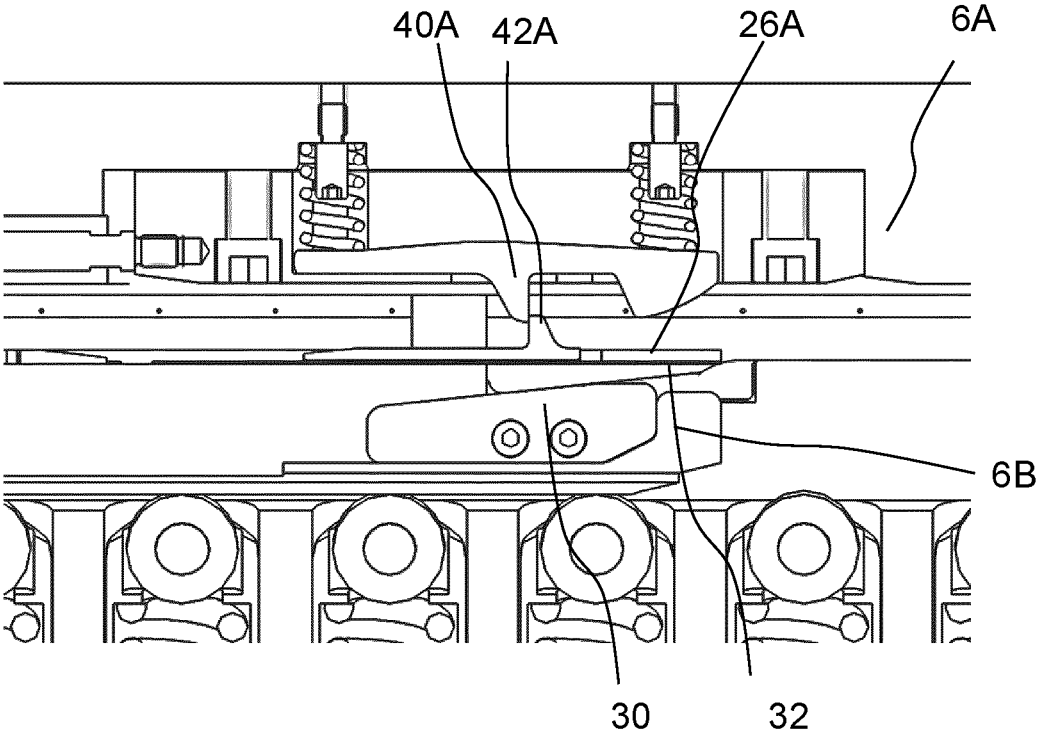
FIG. 6 shows an enlarged schematic view of a cooperating element and a catch profile element.

FIG. 6 shows in details the cooperation between the first and a second catch profile elements (i.e. cooperating element) 40A, 40B illustrated as an enlarged view of FIG. 3. Each cooperating element 40A, 40B comprises a ramp adjacent to at least one claw, preferably two claws. Each catch profile element 40A, 40B is resiliently connected to the corresponding slide housing 6A or unit 6B via a biasing element (e.g. a pair helical spring) so that the corresponding catch profile element 40A, 40B can be biased in an axial direction. When slide unit 6A is positioned in an end stroke (left side in FIG. 3), a protrusion 42A, 42B formed on the respective sliding element 26A, 26B extends within a groove formed by two adjacent claws. When the sliding unit 6B is displaced relative to the slide housing 6A, a lateral side of one of the claws engages the corresponding lateral side of the protrusion 42A, 42B in such a manner that the respective sliding element 26A, 26B is pulled in a longitudinal direction by the contacting claw of catch profile element 40A, 40B. Once the sliding element 26A, 26B present a certain level of resistance following an increase tightening of the first or second refractory closure plate 8A, 8B, the biasing element of the catch profile element 40A, 40B is compressed by a force within an axial direction resulting from the pressure exerted by the protrusion 42A, 42B on the catch profile element 40, 40B. The axial force results from the shape of the profiles selected for the protrusion 42A, 42B and the claws. Once the displacement between the slide housing 6B and the slide unit 6A reaches a certain amplitude, the protrusion 42A, 42B disengages from the catch profile element 40A, 40B.

Although the present invention has been described and illustrated in detail, it is clearly understood that the same is by way of illustration and example only and is not to be taken by way of limitation, the scope of the present invention being limited only by the terms of the appended claims.

The invention claimed is:

1. Slide closure for a vessel that operatively contains molten metal, comprising:

a slide housing including a recess receiving a first refractory closure plate presenting a first face with a first flow-through opening;

a slide unit including an opening receiving a second refractory closure plate presenting a second face with a second flow-through opening;

wherein said slide closure is arranged such that the slide unit is displaced relative to the slide housing in a longitudinal direction;

wherein said slide closure is further arranged such that one of a gap or a pressure between opposing first and second faces of the first and second refractory closure plate can be adjusted by parallel displacement in an axial direction;

wherein at least one clamping mechanism is arranged in one or more of the slide housing and the slide unit, the at least one clamping mechanism adapted to clamp a corresponding refractory closure plate; and wherein the at least one clamping mechanism is arranged to start the clamping of the corresponding refractory closure plate via an actuation of the at least one clamping mechanism when the slide unit is displaced relative to the slide housing and the first and the second refractory closure plates are apart from each other, before the first and the second faces of the respective first and the second refractory closure plates are in contact under pressure.

2. The slide closure according to claim 1, wherein the at least one clamping mechanism is arranged to end the actuation of the at least one clamping mechanism of the corresponding refractory closure plate before the first and the second faces of the respective first and the second refractory closure plates are in contact under pressure.

3. The slide closure according to claim 1, wherein said slide closure comprises at least one ramp engaging with at least one corresponding guiding element arranged on the slide unit, wherein said ramp and said guiding element are arranged to move apart the slide unit from the slide housing when the slide unit reaches one of a specific portion of a stroke of the slide unit, and an end stroke of the slide unit.

4. The slide closure according to claim 1, wherein the at least one clamping mechanism comprises a first clamping mechanism and a second clamping mechanism, wherein the first clamping mechanism is arranged on the slide housing and is actuated by a first cooperating element arranged on the slide unit, wherein the second clamping mechanism is arranged on the slide unit and is actuated by a second cooperating element arranged on the slide housing.

5. The slide closure according to claim 4, wherein one of the first cooperating element and the second cooperating element comprises a catch profile element.

6. The slide closure according to claim 5, wherein each catch profile element presents a ramp adjacent to at least one claw or adjacent to two claws.

7. The slide closure according to claim 5, wherein each catch profile element is connected to the corresponding slide housing or slide unit so that said catch profile element is configured to be biased in an axial direction.

8. The slide closure according to claim 5, wherein the sliding element of the slide housing or slide unit comprises a protrusion adapted to cooperate with the catch profile element arranged on the corresponding opposing slide unit or slide housing, wherein each catch profile element can push the corresponding sliding element via said protrusion in the longitudinal direction while the slide unit is displaced relative to the slide housing.

9. The slide closure according to claim 1, wherein the at least one clamping mechanism comprises a spring element.

10. The slide closure according to claim 9, wherein the spring element is shaped as a U spring clip, two ends of said spring element corresponding to two branches of the U.

11. The slide closure according to claim 10, wherein the spring element is pivotable on a shaft mounted on the corresponding slide housing or slide unit, wherein a pivot is located in a median position of said spring element at an apex of the U.

12. The slide closure according to claim 10, wherein the spring element of the slide housing or the slide unit comprises a spring element having one end abutting against a portion of a sidewall of the corresponding first or second refractory closure plate and the other end abutting against a pre-tensioning element arranged on the corresponding slide housing or slide unit.

13. The slide closure according to claim 12, wherein the spring element of the slide housing or slide unit comprises a further spring element having one end abutting against another portion of the sidewall of the corresponding first or second refractory closure plate and the other end abutting against an abutment element mounted on the corresponding slide housing or unit, or wherein another portion of the sidewall of the corresponding first or second refractory closure plate abuts directly against an abutment element mounted on the corresponding slide housing or slide unit.

14. The slide closure according to claim 12, wherein each pre-tensioning element is a sliding element comprising a sidewall in sliding contact with the other end of the corresponding at least one spring element of the slide housing or unit, said sidewall and a shape of said spring element being both arranged such that a longitudinal displacement of said sliding element squeezes said plate within its recess.

15. Method for placement of refractory closure plates in a slide closure according to claim 1 comprising the following steps:

providing respectively a first clamping mechanism and a second clamping mechanism to a slide housing and a slide unit;

inserting respectively a first refractory closure plate and a second refractory closure plate within recesses of the slide housing and the slide unit respectively when the slide closure is in an accessible position;

closing the slide closure so that the slide unit is facing the slide housing; and starting the clamping of at least one of the first and second refractory closure plates when the slide unit is displaced relative to the slide housing and a first surface and a second surface of the respective first and second refractory closure plates are apart from each other, before the first surface and the second surface of the respective first and second refractory closure plates are under working pressure.

* * * * *